US009915456B2

(12) United States Patent
Burns et al.

(10) Patent No.: US 9,915,456 B2
(45) Date of Patent: Mar. 13, 2018

(54) SYSTEM AND METHOD FOR CONTROLLING VAPOR COMPRESSION SYSTEMS

(71) Applicant: Mitsubishi Electric Research Laboratories, Inc., Cambridge, MA (US)

(72) Inventors: Daniel J Burns, Wakefield, MA (US); Scott A Bortoff, Brookline, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 208 days.

(21) Appl. No.: 14/729,163

(22) Filed: Jun. 3, 2015

(65) Prior Publication Data

US 2016/0356509 A1 Dec. 8, 2016

(51) Int. Cl.

| | |
|---|---|
| ***F24F 3/00*** | (2006.01) |
| ***F25B 49/02*** | (2006.01) |
| ***F25B 39/02*** | (2006.01) |
| *F25B 13/00* | (2006.01) |

(52) U.S. Cl.

CPC ..... *F25B 49/02* (2013.01); *F25B 39/028* (2013.01); *F25B 13/00* (2013.01); *F25B 2313/0233* (2013.01); *F25B 2600/2513* (2013.01); *F25B 2700/21175* (2013.01)

(58) Field of Classification Search

CPC ..... F24F 3/065; F24F 11/001; F24F 11/006; F24F 2011/0045; F24F 2011/0046; F24F 2011/0061; F25B 39/028; F25B 49/02; F25B 13/00; F25B 2312/0233; F25B 2600/2513; F25B 2700/21175

USPC ..... 165/207

See application file for complete search history.

(56) References Cited

U.S. PATENT DOCUMENTS

| | | | | |
|---|---|---|---|---|
| 2,785,540 | A * | 3/1957 | Biehn | F25B 13/00 62/159 |
| 3,132,490 | A * | 5/1964 | Schmidt | F25B 13/00 62/155 |
| 3,150,501 | A * | 9/1964 | Moore | F25B 13/00 62/174 |
| 3,358,470 | A * | 12/1967 | Frediani | F25B 13/00 62/196.4 |
| 4,057,976 | A * | 11/1977 | del Toro | F25B 39/00 165/97 |
| 5,921,092 | A * | 7/1999 | Behr | A47F 3/0482 62/155 |
| 8,689,582 | B2 | 4/2014 | Birkelund et al. | |
| 8,794,028 | B2 | 8/2014 | Petersen et al. | |

(Continued)

*Primary Examiner* — Justin Jonaitis

(74) *Attorney, Agent, or Firm* — Gene Vinokur; James McAleenan; Hironori Tsukamoto

(57) ABSTRACT

A vapor compression system includes a heat exchanger having an inlet header pipe connected to a set of paths for passing refrigerant to condition a controlled zone. The inlet header pipe splits the refrigerant into different paths. An amount of the refrigerant entering the inlet header pipe is controlled by a valve. The vapor compression system also includes a set of sensors for measuring temperatures of the refrigerant in each path of the set of paths and a controller including a processor for determining a position of the valve based on the measurements of at least one sensor from the set of sensors and a thermal capacity requested for the heat exchanger.

18 Claims, 11 Drawing Sheets

(56) References Cited

U.S. PATENT DOCUMENTS

| | | | | |
|---|---|---|---|---|
| 2008/0184713 | A1* | 8/2008 | Huff | F25B 6/04 62/56 |
| 2009/0277197 | A1 | 11/2009 | Gambiana et al. | |
| 2009/0293515 | A1* | 12/2009 | Lifson | F24D 17/02 62/117 |
| 2010/0077777 | A1* | 4/2010 | Lifson | F25B 9/008 62/117 |
| 2011/0017438 | A1 | 1/2011 | Huazhao et al. | |
| 2013/0312944 | A1 | 11/2013 | Gao et al. | |

* cited by examiner

SYSTEM AND METHOD FOR CONTROLLING VAPOR COMPRESSION SYSTEMS

FIELD OF THE INVENTION

This invention relates to vapor compression systems and more particularly to a system and a method for controlling of the vapor compression system suitable for control of a multi-zone vapor compression system.

BACKGROUND OF THE INVENTION

Vapor compression systems (VCS) move thermal energy between a low temperature environment and a high temperature environment in order to perform cooling or heating operations and to improve comfort of the occupants. For example, heat can be moved from an indoor space to an outdoor space in order to lower the indoor temperature in a cooling operation, or heat can be moved from an outdoor space to an indoor space in order to raise the indoor temperature in a heating operation.

The heat load, or rate at which the thermal energy is moved into a space (e.g., by hot air passing into a building) is generally not directly measured, but its effect is detected as changes in the indoor space temperature or zone temperature. In order to control the zone temperature, the operations of the VCS modulates the cooling or heating capacity provided by the system to counteract the load such that the zone temperature is near a desired zone temperature. The thermal capacity of a heat exchanger is the rate at which the thermal energy is accepted or rejected by a heat exchanger.

A multi-zone vapor compression system (MZ-VCS) includes a single compressor connected to a multiple heat exchangers arranged in one or more indoor zones. The heating or cooling capacity of such indoor heat exchangers is modulated by duty cycling each heat exchanger between "ON" and "OFF" modes of the operation. The heat exchanger is OFF when an inlet valve that controls refrigerant flow is closed or alternatively, the compressor that pumps refrigerant through the system is stopped, so that no cooling or heating is performed by the heat exchanger. The heat exchanger is ON when an inlet valve is opened and the compressor is operating so that the heat exchangers in the indoor zones operate at their full thermal capacity. A controller decides how to alternate between the modes based on a difference between the zone temperature and desired zone temperature.

However, the act of switching heat exchangers ON and OFF, especially in MZ-VCS where the zone heat exchangers can switch ON and OFF independently from each other, result in persistent periodic variations in the outputs of the system, such as zone temperatures and heat exchanger temperatures, that are known to be inefficient and reduce occupant comfort. Accordingly, there is a need in the art for a control system and method to smoothly control the thermal capacity of heat exchangers, such as the heat exchangers of MZ-VCS.

The smooth control the thermal capacity of heat exchangers is even more challenging for the heat exchangers designed with multiple parallel refrigerant flow paths splitting the flow of the refrigerant. Splitting the refrigerant flow within a heat exchanger decrease the flow rates of the refrigerant mass within individual paths allowing longer transit time for refrigerant within the heat exchanger, hence, providing more opportunity for the heat exchange and thereby increasing system efficiency.

However, it is commonly recognized that evenly distributing refrigerant among the multiple paths of a multi-path heat exchanger is difficult to arrange. For example, the theoretically equally split refrigerant flows more into one path than to the other path causing the complications in thermal management of the heat exchangers. A number of conventional methods aim to address the problem of uneven distribution of the refrigerant.

For example, one method uses a specially designed header pipe distributing refrigerant to the multiple paths so that the refrigerant in each path is uniform, see e.g., U.S. 2011/0017438 and U.S. 2013/0312944. Another method uses a complicated distributor including a header pipe and a multiplicity of controllable valves to achieve even refrigerant distribution by actively metering the amount of refrigerant allowed on each path, see, e.g., U.S. Pat. No. 8,794,028 and U.S. Pat. No. 8,689,582. However, all those methods increase the cost of the VCS and do not always achieve an optimal result.

Accordingly, there is a need in the art for a low cost method for controlling refrigerant flow in multi-path heat exchangers that does not require additional expensive distributors.

SUMMARY OF THE INVENTION

It is an object of some embodiments of an invention to provide a system and a method for controlling operations of a vapor compression system (VCS) suitable for controlling a multi-zone vapor compression system (MZ-VCS). It is another object of some embodiments to provide a system and method for controlling a heat exchanger to asymptotically deliver the thermal capacity requested from the heat exchanger without a need to induce oscillations or limits cycles. It is a further object of some embodiments to provide a system and method for controlling the thermal capacity of heat exchangers without requiring new actuators such as additional valves.

Some embodiments of the invention are based on a realization that the previously considered problem of non-uniform refrigerant distribution in a multi-path heat exchanger can be turned into an advantage. To that end, some embodiments of the invention instead of using expensive solutions to fix the non-uniform refrigerant distribution problem use that non-uniform distribution to better control the heat exchangers and to provide a system and a method for control of the VCS suitable for control of the MZ-VCS.

For example, some embodiments of the invention are based on recognition that the VCS with a single heat exchanger controls the single valve of the heat exchanger based on a temperature of the compressor to achieve low but non-zero superheat temperature. However, for MZ-VCS, such a control is impractical, because there are multiple inlet valves for the single compressor and regulating the compressor temperature does not achieve independent zone cooling control. Therefore, there is a need for an alternative approach to control the valves of the heat exchangers.

Unfortunately, the relationship between thermal capacity and opening of the valve is sensitive to disturbances. Therefore, some embodiments aim to control opening of the valves admitting refrigerant into the heat exchangers based on a temperature of the refrigerant in the corresponding heat exchanger. Due to the physics of the state of the refrigerant passing through the heat exchanger, only superheat and subcool temperatures of the refrigerant can be measured.

However, the region with superheat or subcool temperatures of the refrigerant in a single path across the heat exchanger corresponds only to a fraction of values of the thermal capacity formed by different openings of the valve, which makes temperature sensing inefficient control variable.

However, in multi-path heat exchangers, a flow rate of refrigerant is different for each path. It was realized that this preferential flow pattern is repeatable and measurable with sensors placed along the individual paths. Uneven distribution of refrigerant mass within a multi-path heat exchanger results in different superheat or subcool points for different paths. Thus, different sensors in different paths can measure the superheat for different values of cooling capacity that covers the entire range of the position of the valve.

It was further realized that the thermal capacity of the overall heat exchanger can be smoothly controlled by using the single expansion valve to asymptotically regulate the per-path temperatures to setpoints determined in a particular way. Also, it was realized that by specifying the selected path setpoint temperature as a function of the time varying local zone temperature and either the system evaporating temperature or the system condensing temperature, the thermal capacity of each indoor heat exchanger can be determined independently from unmeasurable disturbances such as heat loads.

Therefore, in some embodiments of the invention, the thermal capacity of heat exchanger in a multi-zone vapor compression system is controlled by exploiting refrigerant distribution in multi-path heat exchangers. Temperature sensors measure path temperatures and expansion valve openings are determined to drive path temperatures to setpoints. In this manner, the heat exchanger capacity can be smoothly controlled without introducing additional actuators.

Accordingly, one embodiment of the invention discloses a vapor compression system (VCS) including a heat exchanger having an inlet header pipe connected to a set of paths for passing refrigerant to condition a controlled zone, wherein the inlet header pipe splits the refrigerant into different paths; a set of sensors for measuring temperatures of the refrigerant in each path of the set of paths; a valve for controlling an amount of the refrigerant entering the inlet header pipe; and a controller including a processor for determining a position of the valve based on the measurements of at least one sensor from the set of sensors and a thermal capacity requested for the heat exchanger.

Another embodiment discloses a vapor compression system including a heat exchanger having an inlet header pipe connected to a set of paths for passing refrigerant to condition a controlled environment, wherein the set of paths includes at least a first path and a second path, and wherein the inlet header pipe splits the refrigerant into the first path and the second paths; a set of sensors for measuring temperatures of the refrigerant in the set of paths, wherein the sensors include at least a first sensor for measuring the temperature in the first path and a second sensor for measuring the temperature in the second path; a valve for controlling an amount of the refrigerant entering the inlet header pipe; and a processor for selecting between the first sensor and the second sensor based on a requested thermal capacity of the heat exchanger and for adjusting a position of the valve based on the measurements of the selected sensor and the requested thermal capacity.

Yet another embodiment discloses a vapor compression system including an outdoor heat exchanger; a set of indoor heat exchangers for conditioning a set of zones, each indoor heat exchanger conditions a corresponding zone and includes a set of paths for passing refrigerant, a set of sensors for measuring temperature of the refrigerant in the set of paths and a valve for controlling an amount of the refrigerant entering the each indoor heat exchanger; a supervisory controller for determining thermal capacity requested for each indoor heat exchanger based on temperature requested for the corresponding zone; and a set of capacity controllers, there is one capacity controller for each indoor heat exchanger for determining a setpoint temperature of the refrigerant passing through at least one path in the indoor heat exchanger and for adjusting the position of the valve of the indoor heat exchanger to reduce an error between the setpoint temperature and the measured temperature of the refrigerant in the path.

DEFINITIONS

In describing embodiments of the invention, the following definitions are applicable throughout (including above).

A "computer" refers to any apparatus that is capable of accepting a structured input, processing the structured input according to prescribed rules, and producing results of the processing as output. Examples of a computer include a computer; a general-purpose computer; a supercomputer; a mainframe; a super mini-computer; a mini-computer; a workstation; a microcomputer; a server; an interactive television; a hybrid combination of a computer and an interactive television; and application-specific hardware to emulate a computer and/or software. A computer can have a single processor or multiple processors, which can operate in parallel and/or not in parallel. A computer also refers to two or more computers connected together via a network for transmitting or receiving information between the computers. An example of such a computer includes a distributed computer system for processing information via computers linked by a network.

A "central processing unit (CPU)" or a "processor" refers to a computer or a component of a computer that reads and executes software instructions.

A "memory" or a "computer-readable medium" refers to any storage for storing data accessible by a computer. Examples include a magnetic hard disk; a floppy disk; an optical disk, like a CD-ROM or a DVD; a magnetic tape; a memory chip; and a carrier wave used to carry computer-readable electronic data, such as those used in transmitting and receiving e-mail or in accessing a network, and a computer memory, e.g., random-access memory (RAM).

"Software" refers to prescribed rules to operate a computer. Examples of software include software; code segments; instructions; computer programs; and programmed logic. Software of intelligent systems may be capable of self-learning.

A "module" or a "unit" refers to a basic component in a computer that performs a task or part of a task. It can be implemented by either software or hardware.

A "control system" refers to a device or a set of devices to manage, command, direct or regulate the behavior of other devices or systems. The control system can be implemented by either software or hardware, and can include one or several modules.

A "computer system" refers to a system having a computer, where the computer comprises computer-readable medium embodying software to operate the computer.

A "network" refers to a number of computers and associated devices that are connected by communication facilities. A network involves permanent connections such as cables, temporary connections such as those made through telephone or other communication links, and/or wireless connections. Examples of a network include an internet, such as the Internet; an intranet; a local area network (LAN); a wide area network (WAN); and a combination of networks, such as an internet and an intranet.

A "vapor compression system" refers to a system that uses the vapor compression cycle to move refrigerant through components of the system based on principles of thermodynamics, fluid mechanics, and/or heat transfer.

An "HVAC" system refers to any heating, ventilating, and air-conditioning (HVAC) system implementing the vapor compression cycle. HVAC systems span a very broad set of systems, ranging from systems which supply only outdoor air to the occupants of a building, to systems which only control the temperature of a building, to systems which control the temperature and humidity.

"Components of a vapor compression system" refer to any components of the vapor compression system having an operation controllable by the control systems. The components include, but are not limited to, a compressor having a variable speed for compressing and pumping the refrigerant through the system; an expansion valve for providing an adjustable pressure drop between the high-pressure and the low-pressure portions of the system, and an evaporating heat exchanger and a condensing heat exchanger, each of which incorporates a variable speed fan for adjusting the air-flow rate through the heat exchanger.

An "evaporator" refers to a heat exchanger in the vapor compression system in which the refrigerant passing through the heat exchanger evaporates over the length of the heat exchanger, so that the specific enthalpy of the refrigerant at the outlet of the heat exchanger is higher than the specific enthalpy of the refrigerant at the inlet of the heat exchanger, and the refrigerant generally changes from a liquid to a gas. There may be one or more evaporators in the vapor-compression system.

A "condenser" refers to a heat exchanger in the vapor compression system in which the refrigerant passing through the heat exchanger condenses over the length of the heat exchanger, so that the specific enthalpy of the refrigerant at the outlet of the heat exchanger is lower than the specific enthalpy of the refrigerant at the inlet of the heat exchanger, and the refrigerant generally changes from a gas to a liquid. There may be one or more condensers in a vapor-compression system.

A "setpoint" refers to a target value the system, such as the vapor compression system, aims to reach and maintain as a result of the operation. The term setpoint is applied to any particular value of a specific set of control signals and thermodynamic and environmental parameters.

"Heat load" refers to the thermal energy rate moved from a low temperature zone to a high temperature zone by the vapor compression system. The units typically associated with this signal are Joules per second or Watts or British Thermal Units per hour (BTUs/hr).

"Thermal capacity" refers to the energy rate absorbed by a heat exchanger in a vapor compression system. The units typically associated with this signal are Joules per second or Watts or British Thermal Units per hour (BTUs/hr).

DETAILED DESCRIPTION OF EMBODIMENTS OF INVENTION

Multi-Zone Vapor Compression System

Figure 1A:
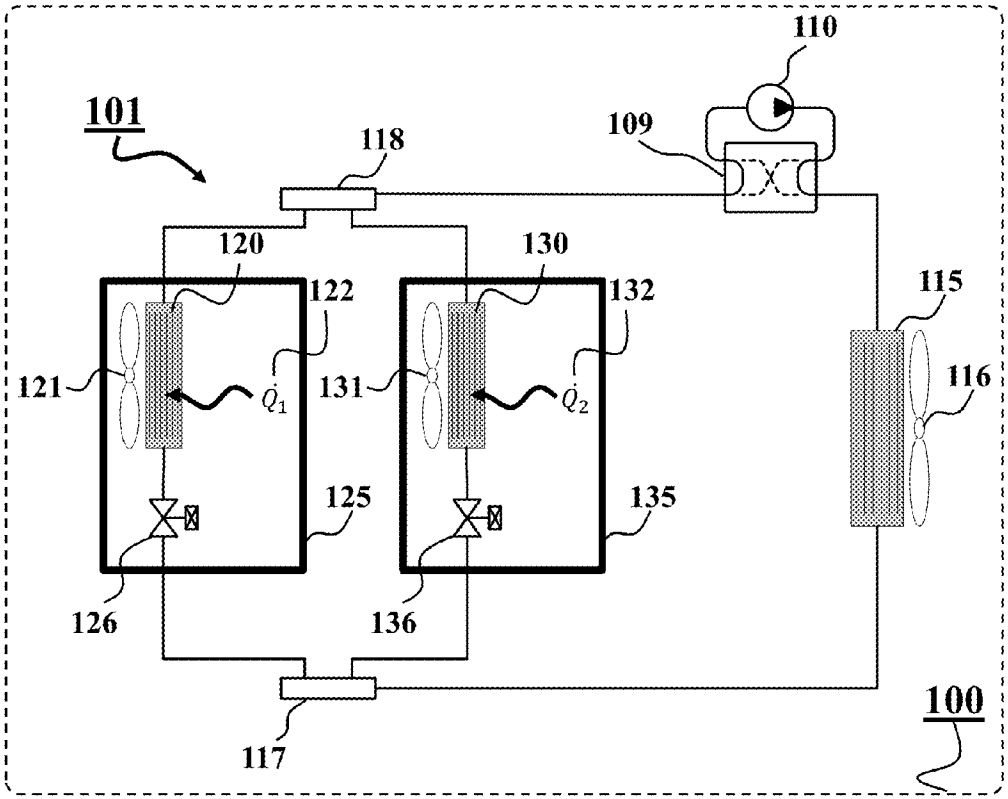
FIGS. 1A and 1B are block diagrams of a multi-zone vapor compression system (MZ-VCS) controlled according to principles employed by some embodiments of an invention.
Figure 1B:
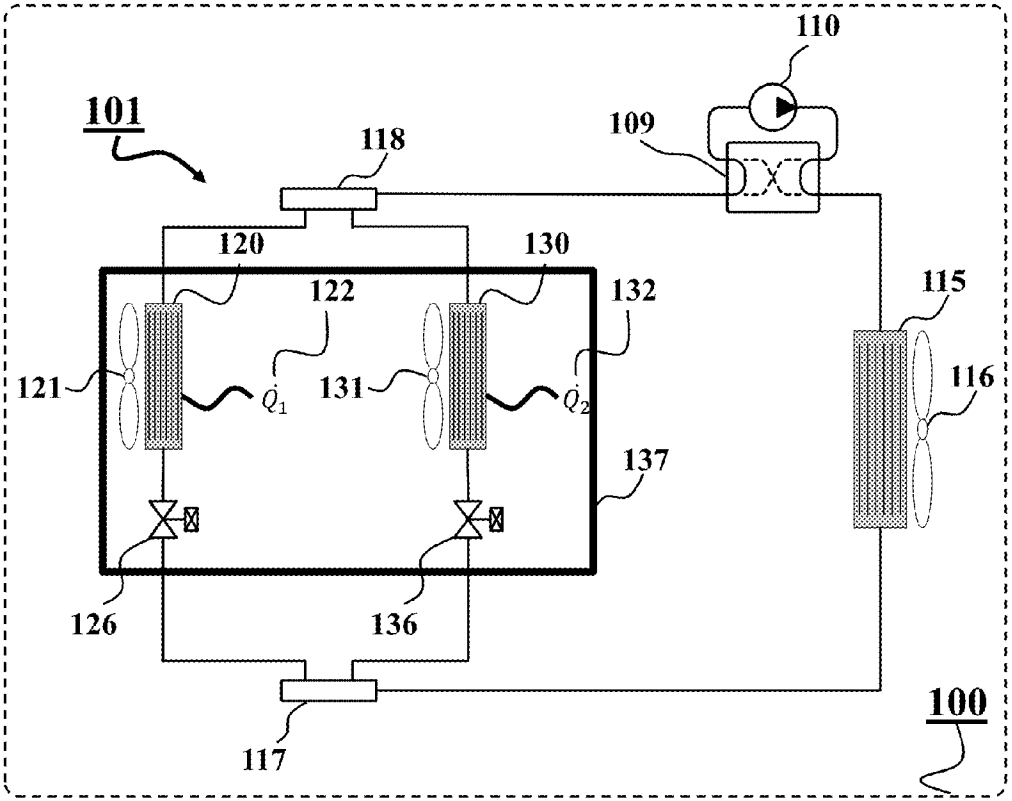

FIGS. 1A and 1B show block diagrams of a multi-zone vapor compression system (MZ-VCS) 100 controlled by a controller 101 according to principles employed by some embodiments of the invention. The MZ-VCS includes one or multiple indoor heat exchangers arranged to condition the controlled environment. For example, in one embodiment of FIG. 1A, each zone 125 or 135 corresponds to a room in a building enabling the MZ-VCS to provide cooling or heating to multiple zones simultaneously.

In alternative embodiment shown in FIG. 1B, multiple heat exchangers are placed in one room or zone 137 in a building enabling the MZ-VCS to provide cooling or heating to different sections of the room. In this disclosure, a two-zone MZ-VCS is described for clarity, but it should be understood that any number of indoor zones can be used, subject to the physical limitations of refrigerant line lengths, capacity and pumping power of the compressor, and building codes.

A compressor 110 receives a low pressure refrigerant in a vapor state and performs mechanical work to increase the pressure and temperature of the refrigerant. Depending on the configuration of a four-way valve 109, the high temperature refrigerant can be routed to either an outdoor heat exchanger (in which case the system moves heat to the outside environment and is proving useful cooling and is said to operate in cooling mode) or to an indoor heat exchanger (in which case the system moves heat to one or more indoor zones and is proving useful heating and is said to operate in heating mode).

For clarity and in order to simplify the subsequent description, a cooling mode is generally considered, i.e., the compressor is connected to the rest of the vapor compression system as shown as solid lines of the four-way valve 109, but it should be understood that analogous statements can be made about the system operating in heating mode with appropriate substitutions of condenser for evaporator, condensing temperature for evaporating temperature.

In cooling mode, the high temperature, high pressure refrigerant moves to an outdoor heat condensing exchanger 115 and an associated fan 116 blows air across the heat exchanger. Heat is transferred from the refrigerant to the air, causing the refrigerant to condense from a vapor to a liquid.

The phase change process wherein vapor refrigerant condenses from saturated vapor to a two-phase mixture of both liquid and vapor to saturated liquid is isothermal in ideal descriptions of the vapor compression cycle, that is, the phase change process occurs at a constant temperature and therefore without a sensible change in temperature. However, if further heat is removed from the saturated liquid, the temperature of the saturated liquid then decreases by an appropriate amount and the refrigerant is termed "subcooled." The subcool temperature is the temperature difference between the subcooled refrigerant and the calculated saturated liquid refrigerant temperature at the same pressure.

Liquid high temperature refrigerant exits the outdoor heat exchanger and is split by a manifold 117 in order to distribute the refrigerant between the subsequently connected indoor zones 125, 135 or 137. Separate expansion valves 126, 136 are connected to the inlet manifold. These expansion valves are restriction elements and cause the pressure of the refrigerant to be substantially reduced. Since the pressure is quickly reduced without substantial heat exchange in the valve, the temperature of the refrigerant is substantially reduced, termed "adiabatic" in ideal descriptions of the vapor compression cycle. The resulting refrigerant exiting the valves is a low pressure, low temperature two-phase mixture of liquid and vapor.

Two-phase refrigerant enters the indoor heat exchangers 120, 130 where associated fans 121, 131 blow air across the heat exchangers. Heat 122, 132 representing the thermal loads from the indoor spaces is transferred from the zones to the refrigerant, causing the refrigerant to evaporate from a two-phase mixture of liquid and vapor to a saturated vapor state.

The phase change process wherein refrigerant evaporates from a saturated vapor to a two-phase mixture of both liquid and vapor to saturated vapor is isothermal in ideal descriptions of the vapor compression cycle, i.e., occurs at a constant temperature and therefore is a process that occurs without a sensible change in temperature. However, if further heat is added to the saturated vapor, the temperature of the saturated vapor then increases by an appropriate amount and the refrigerant is termed "superheated." The superheat temperature is the difference between the superheated refrigerant vapor and the calculated saturated vapor temperature at the same pressure.

The low pressure refrigerant vapor exiting the indoor unit heat exchangers is rejoined to a common flow path at the outlet manifold 118. Finally, low pressure refrigerant vapor is returned to the compressor and the cycle repeats.

The principal actuators in the MZ-VCS 100 include the compressor 110, the outdoor heat exchanger fan 116, the indoor heat exchanger fans 121, 131 and the expansion valves 126, 136. In some systems, the compressor speed can be fixed to one or more predetermined settings, or varied continuously. Similarly, the outdoor heat exchanger fans can operate at fixed speeds or varied continuously. In some configurations, the indoor heat exchanger fans can be determined by the MZ-VCS controller, or its speed can be determined by the occupants when the occupants wish to directly control indoor airflow. The expansion valves are controlled, e.g., electronically-controlled, by the controller 101 to continuously vary from being in fully closed to fully open positions including all possible intermediate positions. Some MZ-VCS implementations substitute electronically-controlled expansion valves with a series combination of a solenoid valve for on/off control, and a separate variable opening valve for precise flowrate control.

The high and low refrigerant pressures are determined by thermodynamic conditions such as outdoor and indoor air temperature, the compressor speed and the joint combination of valve openings. The expansion valves can each be set to different openings, but the overall high and low pressures are determined by the total pressure drop across these valves, which are arranged in parallel in the refrigerant circuit. Note that there are no pressure reducing elements between the indoor heat exchangers 120, 130 and the outlet manifold 118, and therefore all heat exchangers operate at substantially the same pressure. Moreover, due to the previously mentioned isothermal characteristic of phase change, all indoor heat exchangers are constrained to evaporate at the same temperature. This common evaporating temperature Te, represents an important constraint in the operations of MZ-VCS, as explained below.

Problem Overview

The heat loads in each zone are independent, and the desired zone temperatures can be different. As a result, the cooling provided by each heat exchanger is independently controlled by some embodiments in order to meet these distinct thermal requirements. However, this requirement for independent thermal capacity is at odds with the common evaporating temperature constraint. For example, naively changing one valve opening in order to affect the local zone temperature causes the evaporating temperature in all zones to change. Further, while the zone temperature can be influenced by modulating the indoor heat exchanger fan speeds, this method cannot be relied upon because in some application the occupants of the zone are able to specify zone airflow settings independently from zone temperature settings.

In order to achieve independent zone temperatures in a multi-zone air conditioner constrained by a common evaporating pressure, current control strategies identify those indoor heat exchangers that need less cooling (e.g., those zones wherein the zone temperature is below the setpoint temperature and therefore overcooled) and temporarily cut off the flow of refrigerant to those heat exchangers by closing the expansion valves.

Figure 2A:
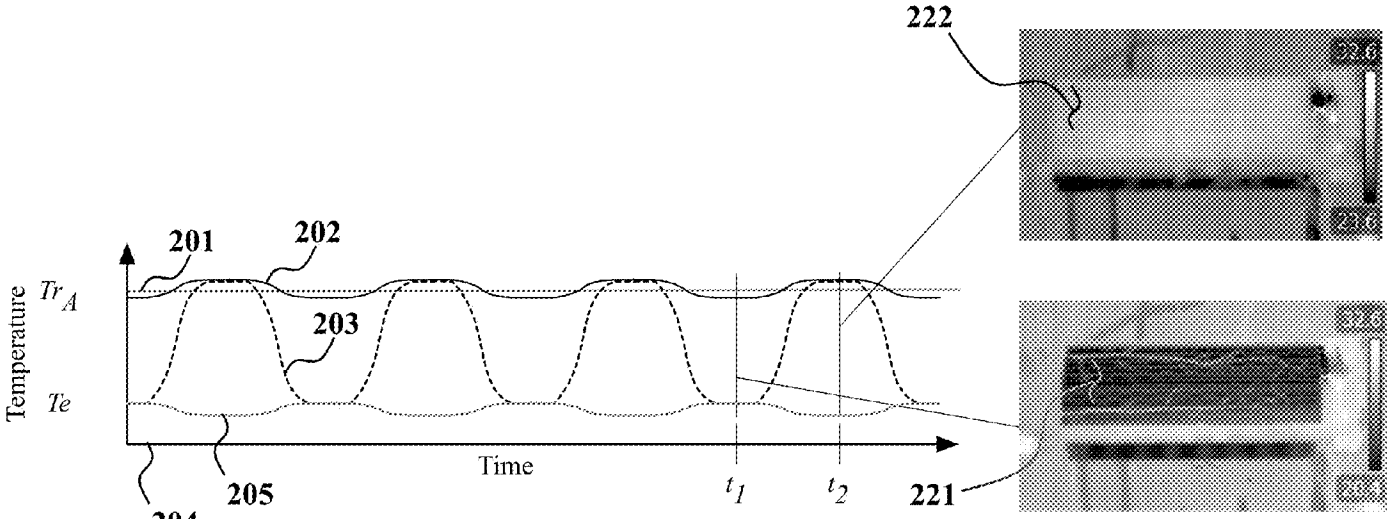
FIG. 2A Prior Art
FIGS. 2A and 2B are schematics of the temperature response as function of time for a conventional control method.
Figure 2B:
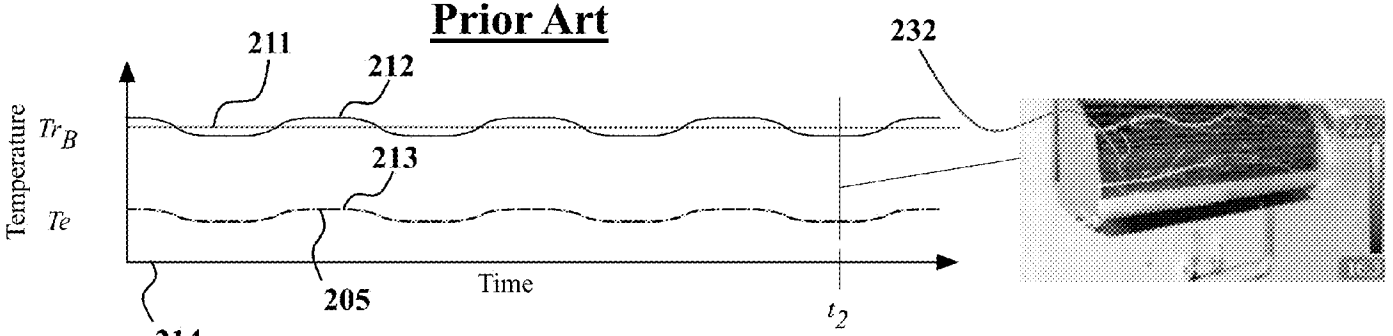
FIG. 2B Prior Art

FIGS. 2A and 2B show the temperature response as function of time as an example of a conventional control method used in prior art. In this example, two zones are considered over the same period. The conditions in zone of FIG. 2A require less cooling than the heat exchanger nominally supplies, and the heat load in zone of FIG. 2B is substantially in thermal equilibrium with the cooling provided by the associated heat exchanger. The images 221, 222, and 232 are thermographic images of the heat exchangers temperature as pixel intensity, where in this case darker pixels represent colder temperatures.

Because zone of FIG. 2A is overcooled, the expansion valve alternates between open and closed, and the heat exchanger surface temperature 203 oscillates between the evaporating temperature Te 205, and the zone temperature $Tr_A$ 202. When the expansion valve is open, the entire heat exchanger 221 is at the evaporating temperature as shown at time $t_1$ in the image 221. Conversely, when the expansion valve is closed, the heat exchanger warms to the zone temperature as shown at time $t_2$ in the image 222. As a result of this ON/OFF duty cycling, the zone temperature oscillates around the zone setpoint temperature 201, indicating that the cooling capacity of the heat exchanger averaged over some time window has been modulated to approximately equal the load.

In this example, the zone of FIG. 2B is in thermal equilibrium, meaning that the heat load is substantially equivalent to the cooling capacity, and therefore the zone temperature is stable when averaged over some time window. However, the on/off cycling of the expansion valve of the heat exchanger for the zone of FIG. 2A causes variations in the system evaporating pressure and therefore of the evaporating temperature 205 which is coincident with the heat exchanger temperature 213. This oscillation in evaporating temperature turn causes oscillation 212 of the temperature in the zone of FIG. 2B. Despite these fluctuations, the thermographic behavior in the zone of FIG. 2B over time largely resembles the image 232 taken at time $t_2$.

The control method used in the prior art, wherein the expansion valves are abruptly opened and closed, induces oscillation in the system evaporating temperature and refrigerant flow rate. Further, because the vapor compression cycle is strongly coupled, changes in evaporating temperature and refrigerant flow rate cause disturbances in many other areas of the machine, e.g., compressor discharge temperature and condensing pressure. Further, these cyclic disturbances are often not transient, but instead persist as limit cycles. Fluctuations induced by the limit cycles can degrade the ability of the machine to smoothly regulate zone temperatures, cause excessively high or low temperatures during peaks of the limit cycle, and consume energy unnecessarily as heat exchangers operating during sharp transients are known to be inefficient.

The duty cycling control of the heat exchanger can be avoided if there is a relationship between the opening of the valve and the requested thermal capacity of the heat exchanger. However, determining a fixed mapping from valve opening to heat exchanger capacity is difficult.

Figure 2C:
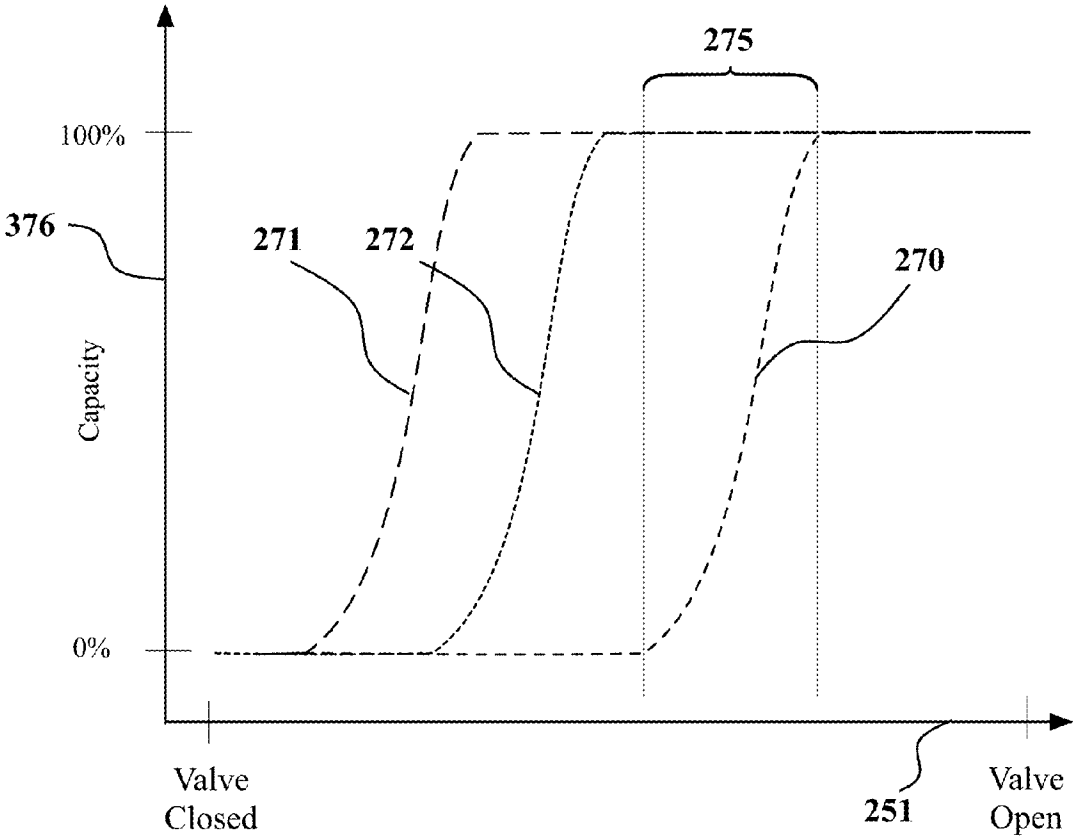
FIG. 2C is a hypothetical mapping between the valve openings and the thermal capacity of the heat exchanger.

FIG. 2C shows a hypothetical mapping 270 between the valve openings 251 and the thermal capacity 276 of the heat exchanger. It was realized, that such a mapping depends on thermodynamic conditions and varies over time. For example, the mapping 270 changes for different set of outdoor air temperature, indoor zone temperatures, heat loads, and configuration of the vapor compression system. FIG. 2C shows three examples of such mappings 270, 271, 272 for different set of thermodynamic conditions.

Unfortunately, the relationship between thermal capacity and opening of the valve is too sensitive to disturbances. The thermodynamic conditions interact nonlinearly with the mapping, so that predicting how these conditions affect the map is difficult, and determining how the thermodynamic conditions influence the mapping through direct experimentation is so time consuming as to be impractical. Therefore it is not practical to control thermal capacity of a heat exchanger based on a direct mapping between valve opening and thermal capacity.

Solution Overview

Some embodiments aim to control opening of the valves admitting refrigerant into the heat exchangers based on a temperature of the refrigerant in the corresponding heat exchanger. Due to the physics of the state of the refrigerant passing through the heat exchanger, only superheat and subcool temperatures of the refrigerant can be measured. However, the region with superheat or subcool temperatures of the refrigerant in a single path across the heat exchanger corresponds only to a fraction of values of the thermal capacity formed by different openings of the valve, which makes temperature sensing inefficient control variable.

However, in multi-path heat exchangers, a flow rate of refrigerant is different for each path. It was realized that this preferential flow pattern is repeatable and measurable with sensors placed along the individual paths. Uneven distribution of refrigerant mass within a multi-path heat exchanger results in different superheat or subcool points for different paths. Thus, different sensors in different paths can measure the superheat for different values of cooling capacity that covers the entire range of the position of the valve.

To achieve the goal of smoothly and continuously controlling the evaporating cooling capacity, an observed behavior of refrigerant mass distribution in multi-path heat exchangers is exploited for control purposes by various embodiments of the invention.

Figure 3A:
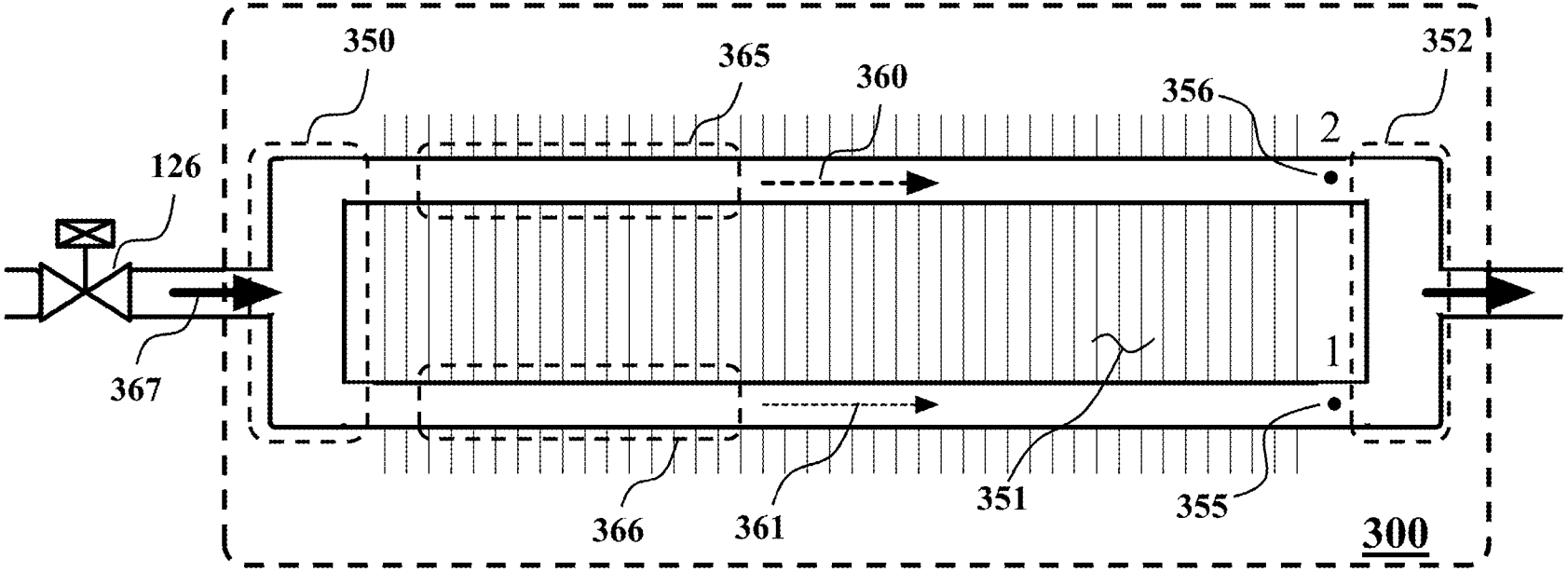
FIG. 3A is a schematic of a multi-path heat exchanger controlled according to various embodiments of the invention.

FIG. 3A shows a schematic of a multi-path heat exchanger 300 controlled by various embodiments of the invention. The a multi-path heat exchanger 300 includes an inlet header pipe 350 that splits incoming refrigerant 367 between two or more paths 365, 366 through the heat exchanging fins 351 and collects those paths into a common outlet header pipe 352. While a two-path heat exchanger is described herein for clarity and brevity, different embodiments use different numbers of paths in a multi-path heat exchanger.

As the expansion valve 126 opening is decreased, the refrigerant mass flow rate entering the heat exchanger is reduced. At some low value of mass flow rate, refrigerant preferentially flows in some paths 360 more than others 361, causing uneven refrigerant distribution in the heat exchanger. This phenomenon of uneven refrigerant distribution is used by the embodiments for capacity control.

Uneven distribution of refrigerant mass within a multi-path heat exchanger can be detected by placing temperature sensors along the different paths, for example, see sensors labeled (1) 355 and (2) 356. In paths with low refrigerant mass flow rates, the two-phase liquid-vapor mixture that enters the heat exchanger completes the evaporation process at some point along the path and becomes superheated, which is sensible by the temperature sensors. The superheat temperature is the difference between the temperature of the saturated vapor refrigerant and the two-phase evaporating temperature, Te. For example, sensor (1) is placed on a path that has reduced refrigerant mass flow rate compared to the other path that includes sensor (2).

Figure 3B:
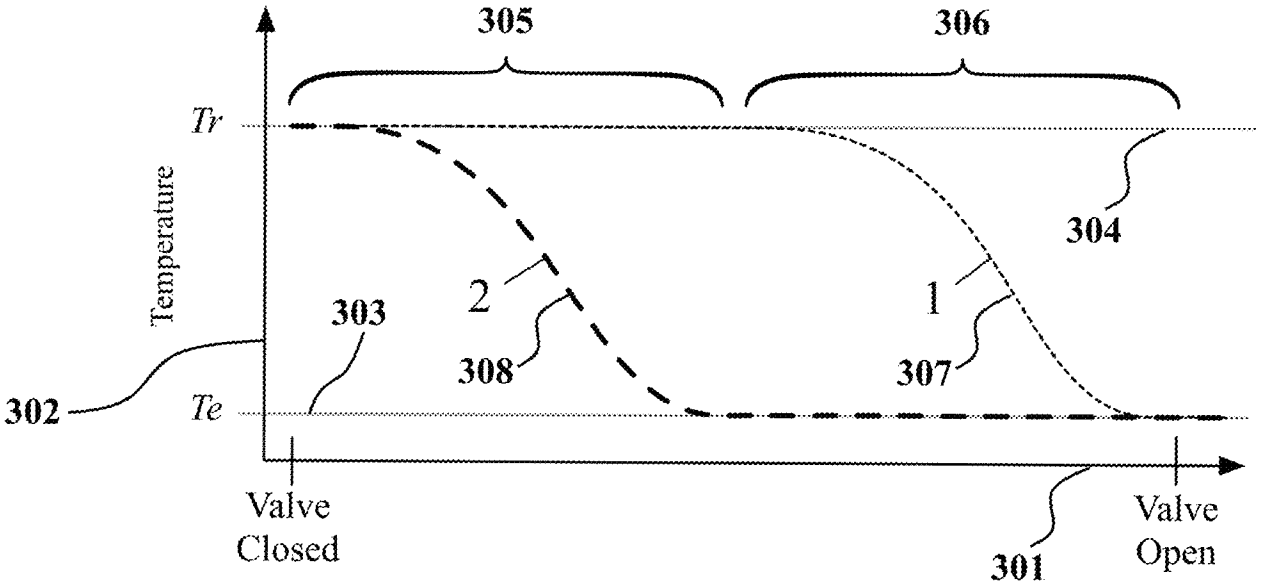
FIG. 3B is a schematic of a temperature response of refrigerant in different paths of a multi-path heat exchanger used by some embodiments.

FIG. 3B shows the temperature response of refrigerant in different paths of a multi-path heat exchanger exploited by some embodiments. As the expansion valve 301 is decreased, the sensible temperature at sensor (1) 307 is increased from the saturated evaporating temperature, Te 303. Eventually, the temperature at sensor (1) is increased until that part of the heat exchanger coil has reached the zone air temperature, Tr 304. The temperature of the heat exchanger is bounded by the evaporating temperature at the low end, and the room temperature at the high end.

In the region label 306, as the temperature measured by sensor (1) is increasing from Te to Tr, the temperature measured by sensor (2) 308 remains saturated at Te, because that path of the heat exchanger remains filled with two-phase refrigerant. In this region, because one path has superheated refrigerant and the other path has refrigerant at the evaporating temperature, the cooling capacity of the overall heat exchanger is relatively high.

As the expansion valve is closed further, the temperature measured by sensor (2) begins to increase from Te to Tr, while the temperature measured by sensor (1) remains saturated at Tr as shown in region labeled 305. In this region, one path has superheated refrigerant and the other path has refrigerant at the room temperature, and the thermal capacity of the overall heat exchanger is relatively low. Therefore, the thermal capacity of the entire heat exchanger can be smoothly varied from relatively high to relatively low by controlling the opening of the expansion valve.

Some embodiments of the invention are based on realization that this preferential flow pattern is repeatable and results in different superheat or subcool points for different paths. Thus, different sensors in different paths can measure the superheat for different values of cooling capacity that covers the entire range of the position of the valve. Therefore, by controlling the path temperatures based on the relationship of FIG. 3B, the thermal capacity is not sensitive to thermodynamic conditions and van be modulated indirectly in a repeatable manner.

Figure 3C:
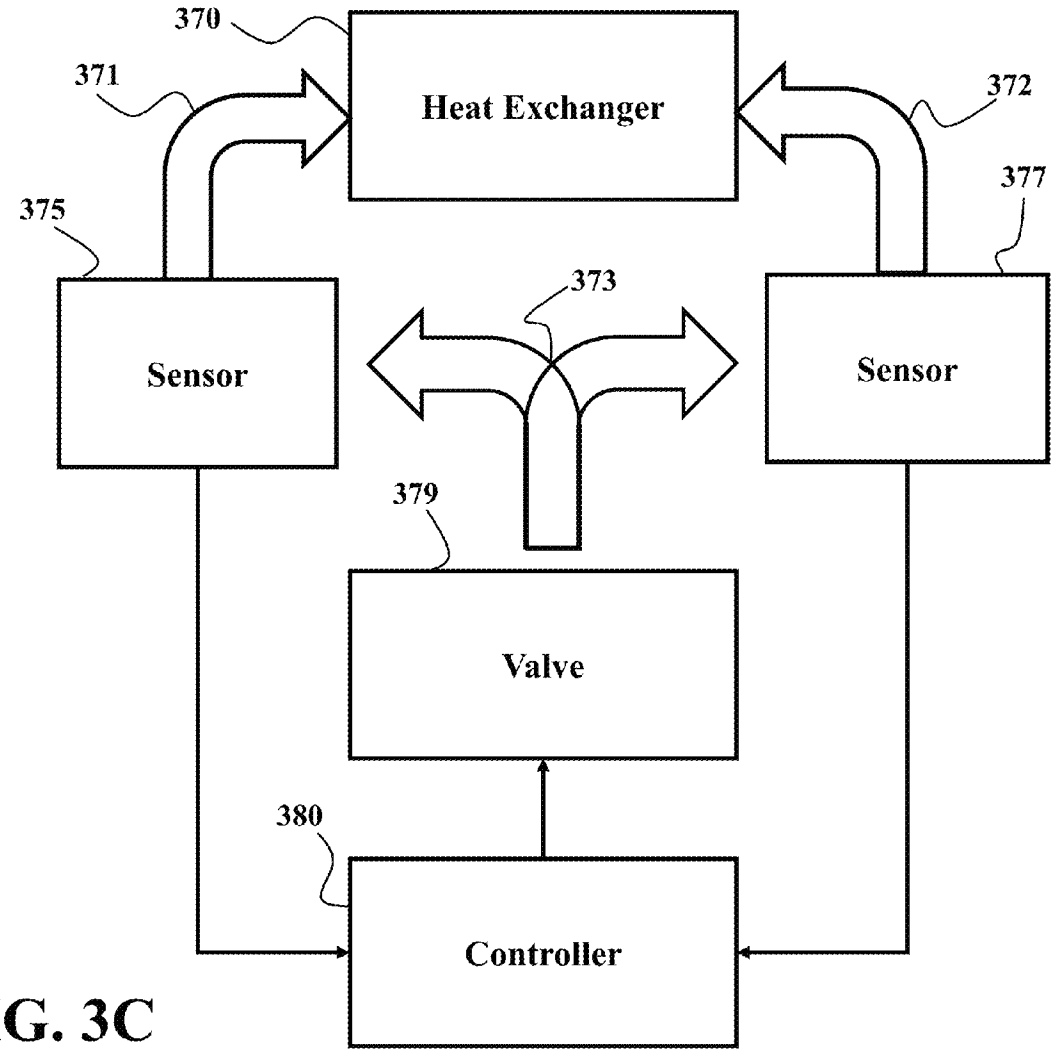
FIG. 3C is a block diagram of vapor compression system (VCS) according to some embodiments of the invention.

FIG. 3C shows a block diagram of VCS according to some embodiments of the invention. The VCS includes a heat exchanger 370 having an inlet header pipe 373 connected to a set of paths for passing refrigerant to condition a controlled zone. For example, the set of path includes a first path 371 and a second path 372. The inlet header pipe 373 splits the refrigerant into different paths from the set of paths, e.g., into the first and the second paths. The VCS also includes a set of sensors for measuring temperature of the refrigerant in each path of the set of paths. For example, the VCS includes a first sensor 375 for measuring temperature of the refrigerant on the first path 371 and includes a second sensor 377 for measuring temperature of the refrigerant on the second path 372.

The VCS also includes a valve 379 for controlling an amount of the refrigerant entering the inlet header pipe 373 and a controller 380 including a processor for determining a position of the valve based on the measurements of at least one sensor from the set of sensors and a thermal capacity requested for the heat exchanger.

In such a manner, the modulation of the thermal capacity is based on a continuous relationship of path temperatures and not on alternating between two discrete ON and OFF modes of operation, the changes in thermal capacity are smooth, which avoids limit cycling characteristics, and the position of the valve asymptotically approach the position corresponding to the requested thermal capacity.

Exemplar Controller

Figure 4A:
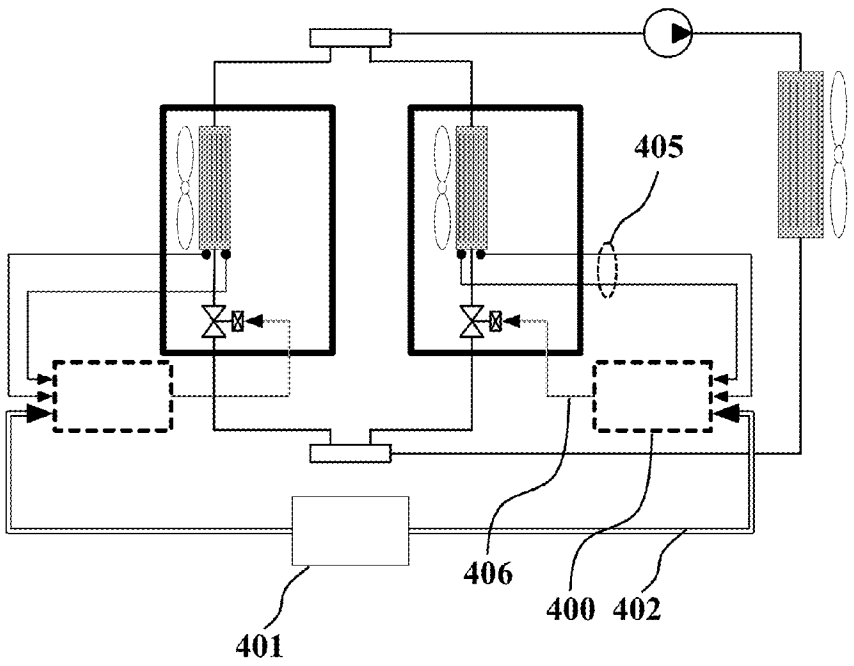
FIG. 4A is a block diagram of a controller for controlling MZ-VCS according to one embodiment of the invention.

FIG. 4A shows a block diagram of a controller for controlling MZ-VCS according to one embodiment of the invention. The controller of this embodiment includes a supervisory controller 401 for determining the thermal capacity needed for achieving the temperature requested for the controlled zone and a capacity controller 400 for determining a setpoint temperature of the refrigerant passing through at least one path of the heat exchanger and for adjusting the position of the valve reducing an error between the setpoint temperature and the measured temperature of the refrigerant in the path. In some embodiments, the MZ-VCS includes an outdoor heat exchanger, a set of indoor heat exchangers and a set of capacity controllers, such that there is one capacity controller for each indoor heat exchanger.

The capacity controller 400 receives signals from temperature sensors 405 arranged on paths of a multi-path heat exchanger and a capacity command providing the requested thermal capacity 402 determined by the supervisory controller 401. The capacity controller provides command signals 406 to adjust the position of the expansion valve such that the capacity of the heat exchanger asymptotically approaches the requested thermal capacity 402.

Figure 4B:
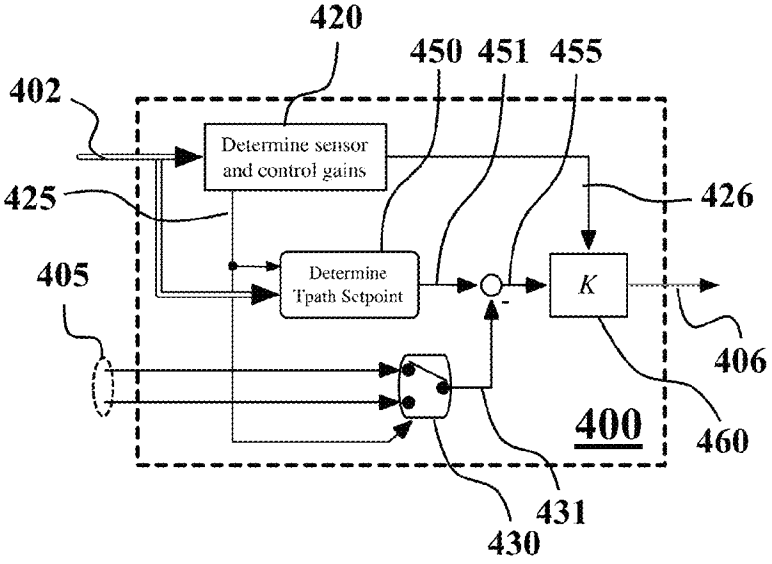
FIG. 4B is a block diagram of an exemplar embodiment of a capacity controller.

FIG. 4B shows a block diagram of an exemplar embodiment of a capacity controller 400. The capacity controller includes a regulator or feedback controller 460 that determines expansion valve commands 406 such that an error signal 455 indicative of an error between the setpoint temperature and the measured temperature of the refrigerant in the path is driven to zero. The feedback controller can be implemented as a proportional-integral-derivative (PID) controller, or some other type of a regulator. The feedback controller regulates the temperature of a sensor positioned on a selected path of the multi-path heat exchanger to a setpoint 451. The particular path to be controlled is determined by a processor executing a setpoint function 420 according to the capacity command 402.

In one embodiment, the feedback controller parameters or gains used in the feedback controller 460 can change based on the selected path. In this embodiment, control gain information 426 is provided by the setpoint function 420 to the feedback controller. This function 420 further provides information 425 to a routine 450 that determines the setpoint for the selected temperature sensor and sets the state of a switch 430 that selects which sensor is used to compute the error signal 455 provided to the feedback controller.

Figure 4C:
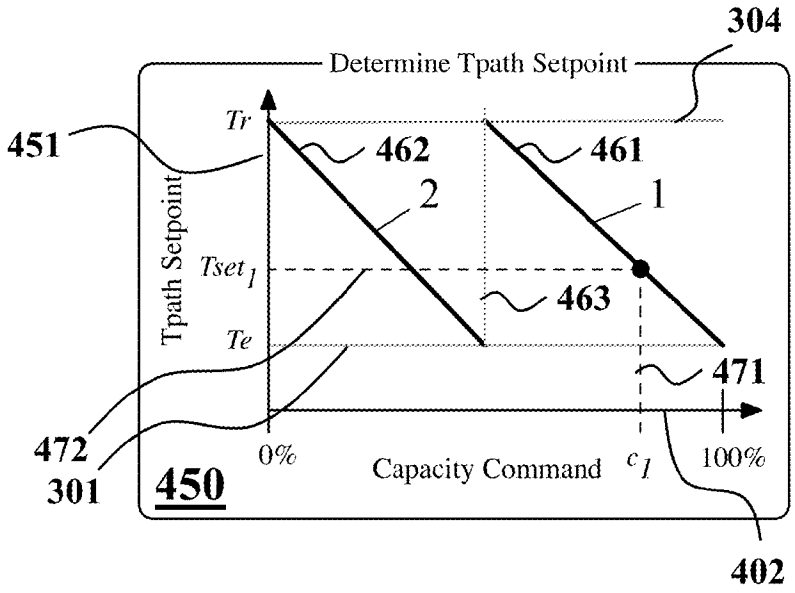
FIG. 4C is an illustration of the setpoint function for determining the setpoint for the selected path according to one embodiment of the invention.

FIG. 4C shows an illustration of the setpoint function used by the routine 450 for determining the setpoint for the selected path according to one embodiment of the invention. Information about the selected path 425 is provided to the routine, which uses this information to select from among the setpoints relationships 461, 462.

In various embodiments, the setpoint function partitions a space of the thermal capacity of the heat exchanger in a set of regions, there is one region for each sensor in the set, such that the requested thermal capacity is mapped by the setpoint function to the setpoint temperature of the selected sensor of a corresponding region. For example, a segment or a relationship 462 of the setpoint function corresponds to the region 305 of the example of FIG. 3B. Similarly, a segment or a relationship 461 of the setpoint function corresponds to the region 306. To that end, the setpoint function is a continuous function that switches 463 at a point of a saturation of the sensors in the set of sensors. Such a construction of the setpoint function allows using the correct sensor corresponding to the requested cooling capacity.

For example, if a relatively high cooling capacity is commanded, the function 420 selects the path containing sensor (1) 307, and the routine selects the setpoint relationship associated with the segment 461. The relationship 461 represents a setpoint for sensor (1) and its specific value depends on the capacity command 402. For example, if the capacity command is $c_1$ 471 and is a relatively high capacity command so that relationship 461 is used, then the setpoint for sensor (1) is determined to be $Tset_1$ 472. For a predetermined transition value of capacity command 463, another path is selected and therefore another relationship is used to determine the corresponding sensor setpoint. The example embodiment shown in FIG. 4C pertains to operation in cooling mode. Analogous embodiments are possible for operation in heating mode with suitable substitutions of condensing temperature for evaporating temperature 301, and a modification of the slops of the setpoint relationships 461, 462.

In cooling mode, the determined setpoint for the selected path temperature sensor is bounded by the evaporating temperature 301 and the corresponding zone temperature 304. Note that these temperatures bounds depend on thermodynamic conditions and therefore can vary with time. For example, the processor of the controller can update the setpoint function in response to a change in the evaporating, condensing or the zone temperatures. By specifying the path temperature setpoint relationships as a function of these time varying bounds, the capacity of the overall heat exchanger is determined independently of thermodynamic conditions.

Figure 5:
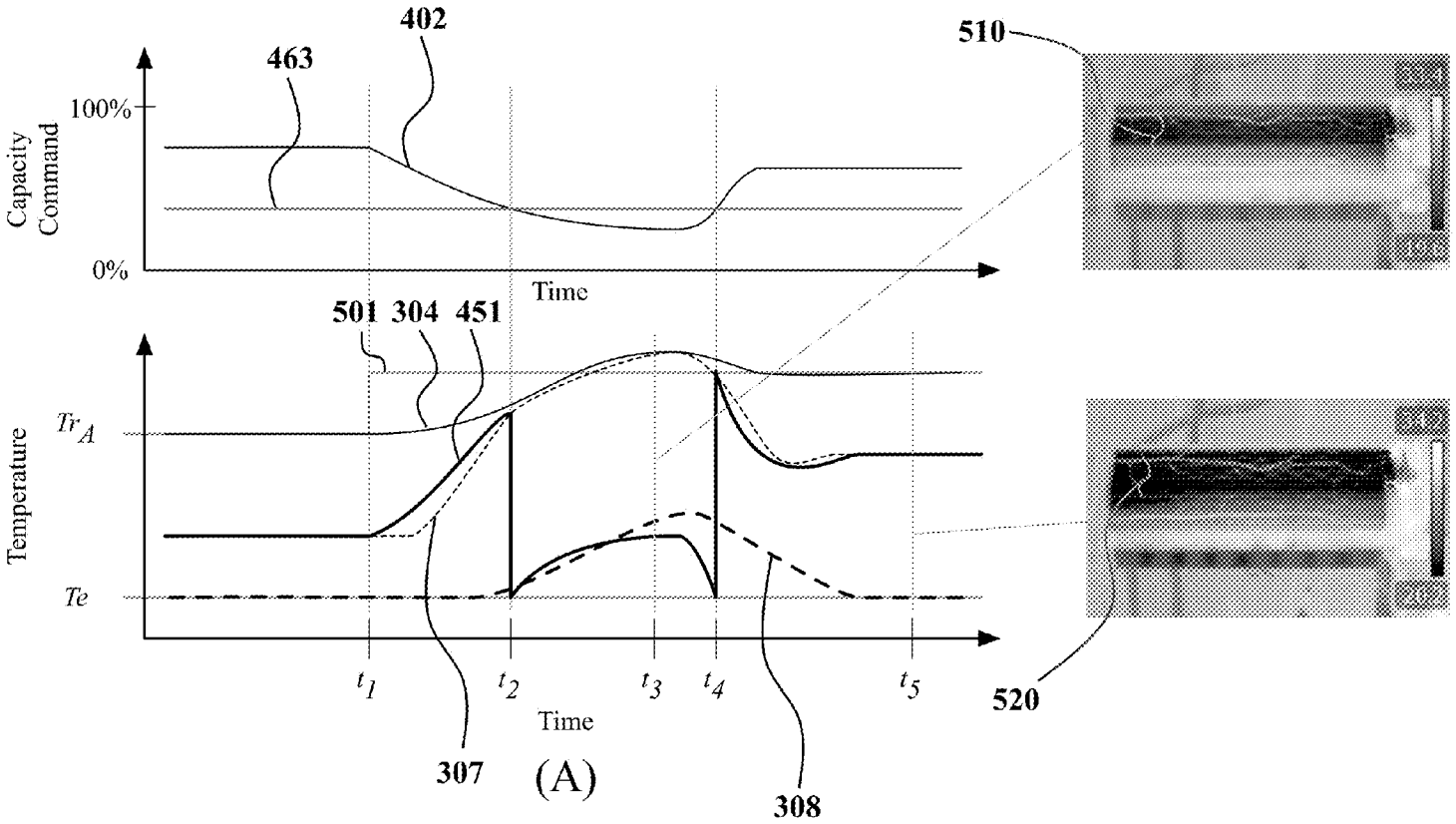
FIG. 5 is an illustration of an example transient in cooling mode of smooth capacity control using an embodiment of the invention.

FIG. 5 shows an example transient in cooling mode of smooth capacity control using an embodiment of the invention. The capacity command 402 is shown in the top plot and is determined by the supervisory controller 401. For example, the supervisory controller modulates the thermal capacity of the heat exchanger in order to drive the zone temperature 304 to a zone setpoint temperature 501, as shown in the bottom plot.

For this example, the initial conditions in this zone are such that steady state occurs with the heat exchanger at a relatively high thermal capacity, and the path setpoint temperature 451 is coincident with the path temperature corresponding to sensor (1) 307 shown as the heavy solid line 451 representing the path setpoint temperature coincident with the thin dashed line 307 representing the temperature measured by sensor (1) in the time leading up to $t_1$. This condition corresponds to the relatively high capacity region 306 of FIG. 3B.

At time $t_1$, the zone setpoint temperature 501 is increased, for example in response to an occupant increasing the setpoint temperature of a thermostat. The supervisory controller determines that the corresponding zone is therefore overcooled, and the capacity command 402 is reduced accordingly. As the capacity command is reduced between times $t_1$ and $t_2$, the path setpoint temperature 451 is increased and ultimately approaches the zone temperature upper bound. The feedback controller 460 part of the capacity controller 400 determines expansion valve commands such that the selected path temperature 307 is driven to the path setpoint temperature 451. This has the effect of smoothly reducing the thermal capacity of the heat exchanger and gradually raising the zone temperature.

At time $t_2$, the zone is still overcooled, but the path monitored by the sensor (1) has reached the zone temperature upper bound. Therefore, the setpoint function 420 selects the sensor (2) and changes the state of the switch 430, and the routine that determines the path setpoint temperature 450 determines the setpoint temperature for sensor (2). This is shown in FIG. 5 as an abrupt change in the path setpoint temperature 451 at time $t_2$, which occurs when the capacity command crosses a predetermined transition value 463. Because both the path setpoint temperature and the selected sensor are switched at the same time and in such a way as to ensure that the error signal provided to the feedback controller is smooth and continuous, the command provided to the expansion valve is smooth and continuous.

From time $t_2$ to $t_4$, the path corresponding to sensor (2) is used by the capacity controller to determine expansion valve commands. In FIG. 5, this is shown as the heavy solid line 451 representing the path setpoint temperature substantially coincident with the thick dashed line 308 representing the temperature measured by sensor (2). This condition corresponds to the relatively low capacity region 305 of FIG. 3B. Also within this time period the zone has become overheated, so the supervisory controller begins to increase the capacity command. At time $t_4$, the capacity command crosses the predetermined transition value 463 and the other path is selected for control.

Two instances from this period are selected as examples for thermographic images in order to illustrate the novel way in which the heat exchangers are controlled in this invention.

At time $t_3$ when the capacity command is relatively low, one path of the heat exchanger is at the zone temperature while the other is selected for capacity control. This situation is shown as a thermographic image 510. The heat exchanger surface temperature in the image 510 is partially at the evaporating temperature (shown as darker pixels) and some relatively large part of the heat exchanger is at the zone temperature.

At time $t_5$ when the capacity command is relatively high, one path of the heat exchanger is at the evaporating temperature while the other is selected for capacity control. This situation is shown as a thermographic image 520. The heat exchanger surface temperature in the image 520 is also partially at the evaporating temperature (shown as darker pixels) and some relatively small part of the heat exchanger is at some temperature between the two bounds.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Though, a processor may be implemented using circuitry in any suitable format.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

What is claimed is:

1. A vapor compression system (VCS), comprising:

a heat exchanger having an inlet header pipe connected to a set of paths for passing refrigerant to condition a controlled zone, wherein the set of paths includes at least a first path and a second path, and wherein the inlet header pipe splits the refrigerant into different paths;

a set of sensors for measuring temperatures of the refrigerant in each path of the set of paths, wherein the sensors include at least a first sensor for measuring the temperature in the first path and a second sensor for measuring the temperature in the second path;

a valve for controlling an amount of the refrigerant entering the inlet header pipe; and a controller including a processor for determining a position of the valve based on the measurements of at least one sensor from the set of sensors and a thermal capacity requested for the heat exchanger, wherein the at least one sensor includes either the first sensor or the second sensor selected based on the requested thermal capacity.

2. The VCS of claim 1, wherein the controller comprises:

a supervisory controller for determining the requested thermal capacity based on temperature requested for the controlled zone; and a capacity controller for determining a setpoint temperature of the refrigerant passing through at least one path of the set of paths and for adjusting the position of the valve to reduce an error between the setpoint temperature and the measured temperature of the refrigerant in the path.

3. The VCS of claim 2, wherein the capacity controller selects between the first sensor and the second sensor based on the requested thermal capacity.

4. The VCS of claim 1, wherein the controller selects a sensor from the set of sensors for measuring the temperature of the refrigerant on a path from the set of paths, determines a setpoint temperature for the selected sensor using a setpoint function mapping the requested thermal capacity to the setpoint temperature for the selected sensor, and adjusts the position of the valve reducing an error between the setpoint temperature and the measurements of the selected sensor.

5. The VCS of claim 4, wherein the setpoint function partitions a space of the thermal capacity of the heat exchanger in a set of regions, there is one region for each sensor in the set, such that the requested thermal capacity is mapped by the setpoint function to the setpoint temperature of the selected sensor of a corresponding region.

6. The VCS of claim 4, wherein the setpoint function is bounded between evaporating or condensing temperature and a zone temperature, and wherein the processor updates the setpoint function in response to a change in the evaporating, condensing or the zone temperatures.

7. The VCS of claim 4, wherein the setpoint function is a continuous function that switches at a point of saturation of each sensor in the set of sensors.

8. The VCS of claim 4, wherein the capacity controller includes a feedback controller, wherein a gain of the feedback controller is selected based on the selected sensor, such that different sensors in the set are associated with different gains.

9. The VCS of claim 1, wherein the heat exchanger is an indoor heat exchanger, and wherein the VCS includes an outdoor heat exchanger and multiple indoor heat exchangers.

10. A vapor compression system (VCS), comprising:

a heat exchanger having an inlet header pipe connected to a set of paths for passing refrigerant to condition a controlled environment, wherein the set of paths includes at least a first path and a second path, and wherein the inlet header pipe splits the refrigerant into the first path and the second paths;

a set of sensors for measuring temperatures of the refrigerant in the set of paths, wherein the sensors include at least a first sensor for measuring the temperature in the first path and a second sensor for measuring the temperature in the second path;

a valve for controlling an amount of the refrigerant entering the inlet header pipe; and a processor for selecting between the first sensor and the second sensor based on a requested thermal capacity of the heat exchanger and for adjusting a position of the valve based on the measurements of the selected sensor and the requested thermal capacity.

11. The VCS of claim 10, wherein the heat exchanger is an indoor heat exchanger, and wherein the VCS includes an outdoor heat exchanger and multiple heat exchangers.

12. The VCS of claim 10, wherein the processor determines a setpoint for the selected sensor using a setpoint function partitioning the thermal capacity of the heat exchanger in a set of regions, there is one region for each sensor in the set, such that the requested thermal capacity is mapped by the setpoint function to a setpoint of selected sensor.

13. The VCS of claim 10, wherein the setpoint function is bounded between evaporating or condensing temperature and zone temperature, and wherein the processor updates the setpoint function in response to a change in the evaporating, condensing or the zone temperatures.

14. The VCS of claim 10, wherein the setpoint function is a continuous function that switches at a point of saturation of a sensor.

15. The VCS of claim 10, further comprising:

a feedback controller for determining the position of the valve reducing an error between a setpoint for the selected sensor and the measurements of the selected sensor.

16. The VCS of claim 15, wherein a gain of the feedback controller is selected based on the selected sensor, such that different sensors in the set are associated with different gains.

17. A vapor compression system (VCS), comprising:

an outdoor heat exchanger;

a set of indoor heat exchangers for conditioning a set of zones, each indoor heat exchanger conditions a corresponding zone and includes a set of paths for passing refrigerant, a set of sensors for measuring temperature of the refrigerant in the set of paths and a valve for controlling an amount of the refrigerant entering the each indoor heat exchanger;

a supervisory controller for determining thermal capacity requested for each indoor heat exchanger based on temperature requested for the corresponding zone; and a set of capacity controllers, there is one capacity controller for each indoor heat exchanger for determining a setpoint temperature of the refrigerant passing through at least one path in the indoor heat exchanger and for adjusting the position of the valve of the indoor heat exchanger to reduce an error between the setpoint temperature and the measured temperature of the refrigerant in the path, wherein the capacity controller receives the measured temperature from either a first sensor or a second sensor from the set of sensors selected based on the thermal capacity determined by the supervisory controller for the capacity controller.

18. The VCS of claim 17, wherein the capacity controller comprises:

a feedback controller for adjusting the position of the valve iteratively to reduce the error until a termination condition is met;

a processor for selecting a sensor from the set of sensors for measuring the temperature of the refrigerant on the path, wherein the selecting is based on the requested thermal capacity; and a switch for operatively connecting the feedback controller to the selected sensor.

* * * * *